US009222204B2

(12) United States Patent
Chen et al.

(10) Patent No.: US 9,222,204 B2
(45) Date of Patent: Dec. 29, 2015

(54) FABRIC ROLLING APPARATUS FOR CIRCULAR KNITTING MACHINES

(71) Applicant: PAI LUNG MACHINERY MILL CO., LTD., New Taipei (TW)

(72) Inventors: Shih-Chi Chen, New Taipei (TW); Peng Cheng Lee, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 78 days.

(21) Appl. No.: 14/168,803

(22) Filed: Jan. 30, 2014

(65) Prior Publication Data

US 2015/0211155 A1 Jul. 30, 2015

(51) Int. Cl.
*D04B 15/88* (2006.01)

(52) U.S. Cl.
CPC ..... *D04B 15/88* (2013.01)

(58) Field of Classification Search
CPC ..... D04B 27/34; D04B 27/36; D04B 15/88
USPC ..... 66/151–153
See application file for complete search history.

(56) References Cited

U.S. PATENT DOCUMENTS 4,233,825 A * 11/1980 Glaspie ..... 66/125 A
4,671,083 A * 6/1987 Sawazaki et al. ..... 66/151
5,317,885 A * 6/1994 Vignoni ..... 66/151
6,276,630 B1 * 8/2001 Mueller et al. ..... 242/598.3
7,204,103 B1 * 4/2007 Chen ..... 66/153
7,441,723 B2 10/2008 Chen
7,905,116 B1 * 3/2011 Chen ..... 66/153

FOREIGN PATENT DOCUMENTS

TW 558573 B 10/2003

* cited by examiner

*Primary Examiner* — Danny Worrell

(74) *Attorney, Agent, or Firm* — Muncy, Geissler, Olds & Lowe, P.C.

(57) ABSTRACT

A fabric rolling apparatus is driven by a circular knitting machine to revolve and receive a knitted fabric. The fabric rolling apparatus comprises a bracket, a transmission rod set located on the bracket and a revolving fabric collection mechanism. The bracket includes two side boxes corresponding to each other and a drive mechanism located in each side box. Each side box has a top side and a bottom side. The drive mechanism drives the transmission rod set to guide movement of the fabric. The revolving fabric collection mechanism includes two revolving arms hinged respectively on the side boxes and a fabric rolling rod driven by the transmission rod set to revolve and roll the fabric. Each revolving arm has a revolving end hinged on the bottom side of the side box and a holding end connected to the fabric rolling rod at an elevation higher than the revolving end.

9 Claims, 7 Drawing Sheets

FABRIC ROLLING APPARATUS FOR CIRCULAR KNITTING MACHINES

FIELD OF THE INVENTION

The present invention relates to a fabric rolling apparatus for circular knitting machines and particularly to a fabric rolling apparatus for circular knitting machines that can adjust fabric pressing force.

BACKGROUND OF THE INVENTION

Circular knitting machines are fundamental equipments in the textile industry. They usually include a plurality of knitting needles on a needle dial and a cylinder to knit yarns of same or different materials to circular fabrics. The knitted fabrics are rolled into a bundle of flat cloth through a fabric rolling machine located below each circular knitting machine.

A conventional fabric rolling machine, such as U.S. Pat. No. 7,441,723, includes a frame, a transmission shaft hinged on the side walls of the frame, a displacement track defined by a lump and a stopper that are parallel with each other and a fabric rolling rod located in the displacement track and driven by the transmission shaft. When the fabric rolling machine is in operation the fabric rolling rod is driven by the transmission shaft to roll the fabric. The fabric rolling rod butts the transmission shaft through the fabric. During the rolling operation, the fabric with increasingly thickness butts the transmission shaft so that the fabric rolling rod is raised vertically in the displacement track. In order to keep the fabric in a flat and neat manner during the rolling operation the fabric rolling rod further has a fabric guiding rod set to draw and stretch the fabric, and also to direct movement of the fabric and provide a tension to the fabric. At the initial fabric rolling stage the fabric rolling rod is driven by the transmission axle and revolves. When the total weight of the fabric rolling rod and fabric is less than the fabric tension the fabric rolling rod is drawn and revolves in a direction opposite to the transmission axle. With gradually increase of the fabric rolled on the fabric rolling rod the total weight of the fabric rolling rod and fabric also increases gradually. The force pressed on the transmission axle below also increases. When the total weight of the fabric rolling rod and fabric is greater than the fabric tension the fabric rolling rod is driven merely by the transmission axle in the same direction thereof; i.e., at the initial stage the rolled fabric is knitted at a greater yarn density and also in a greater thickness, but at the later stage the rolled fabric is knitted at a lower yarn density and in smaller thickness. As a result, a portion of the fabric in the entire roll of fabric does not meet requirement of quality, and it is waste of the fabric knitted by the circular knitting machine.

R.O.C. patent No. 558573 also discloses another type of fabric rolling machine which comprises a machine body, a sub-box, a speed change box and a fabric spreading rack. The machine body has two side boxes and three fabric guiding rods hinged between them at varying heights in a staggered manner. Two bracing rods are provided at the tope end of the side boxes, and a fabric rolling rod is provided at the front end of the side boxes. The fabric rolling rod is movably located in a preset guide track in the side boxes and driven by the fabric guiding rods to rotate. The guide track is inclined and extended against the side boxes. The fabric rolling rod moves in an inclined direction in the guide track with increasing of the rolled fabric. Although the fabric guiding rod is not located directly beneath the guide track, namely, the fabric guiding rod does not bear the total weight of the fabric rolling rod and fabric rolled thereon, but a component force of the total weight according to the inclined angle of the guide track. However, as the fabric rolled on the fabric rolling rod increases gradually the component force of the fabric rolling rod and fabric pressed on the fabric guiding rods also increases; finally, it still happens that the fabric rolled at the initial stage has a greater yarn density and a greater thickness while the fabric rolled at the later stage has a smaller yarn density and a smaller thickness.

SUMMARY OF THE INVENTION

The primary object of the present invention is to solve the inconsistent quality fabric problem of the initial rolling stage and later rolling stage that happens to the conventional fabric rolling machine with increasing of rolling fabric.

To achieve the foregoing object the invention provides a fabric rolling apparatus that is driven by a circular knitting machine to revolve and receive a fabric knitted by the circular knitting machine. The fabric rolling apparatus comprises a bracket, a transmission rod set located in the bracket and a revolving fabric collection mechanism. The bracket includes two side boxes corresponding to each other, a drive mechanism located in the side boxes and a fabric rolling space located between the two side boxes. Each side box has a top side close to the circular knitting machine and a bottom side remote from the circular knitting machine. The transmission rod set is located in the fabric rolling space and driven by the drive mechanism to rotate and guide the fabric to move along a fabric transporting path. The revolving fabric collection mechanism includes two revolving arms hinged respectively on the side boxes and a fabric rolling rod located in the fabric transporting path and driven by the transmission rod set to revolve and roll the fabric. Each revolving arm has a revolving end hinged on the bottom side of the side box and a holding end connected to the fabric rolling rod higher than the revolving end. The fabric rolled on the fabric rolling rod presses the transmission rod set to provide a fabric press component to the transmission rod set. The revolving arm has a revolving fabric collection stroke by flipping upward from the bottom side about the revolving end as an axis with increased fabric amount on the fabric rolling rod to adjust the fabric press component.

In one embodiment the fabric rolling apparatus further includes a drive base located in the fabric rolling space. The drive base includes a revolving base, a speed change box located on the revolving base and at least one transmission shaft extended from the speed change box to output a revolving drive force.

In another embodiment the transmission shaft runs through the bottom side of the side boxes to drive the drive mechanism through a transmission belt.

In yet another embodiment an installation plane is formed between the bottom sides of the two side boxes for installation of the drive base. The installation plane and an extended axis of the revolving arm in the revolving fabric collection stroke form an included angle smaller than 180 degrees.

In yet another embodiment the fabric rolling apparatus further includes a fabric transporting rod set pivotally coupled on the top side of the side boxes. The fabric transporting rod set includes a fabric spreading rod driven by the drive mechanism to revolve and spread the fabric and at least one rolling rod.

In yet another embodiment the fabric spreading rod includes a first thread section and a second thread section in an opposition direction against the first thread section.

In yet another embodiment the transmission rod set includes a first fabric guiding rod pivotally located on the side boxes and a second fabric guiding rod mobbing relatively to the first fabric guiding rod.

In yet another embodiment each side box has a track run through by the second fabric guiding rod to guide movement thereof.

In yet another embodiment the transmission rod set includes a movement dock coupled on the second fabric guiding rod. The movement dock includes a hinge portion hinged on the side boxes and an elastic element connected to the movement dock to provide a return force.

In yet another embodiment the fabric rolling apparatus further includes a fabric split element to split the fabric and a fabric extending bracket to extend the fabric split by the fabric split element.

In yet another embodiment the revolving arm has a revolving fabric unloading stroke about the revolving end as an axis and remote from the fabric rolling space.

In yet another embodiment the bracket includes a fabric unloading bracket located in the revolving fabric unloading stroke.

In yet another embodiment the revolving arm includes a stopper, and each side box includes a limit portion butting the stopper to prohibit the revolving arm to proceed the revolving fabric unloading stroke.

In yet another embodiment the bracket includes at least one buffer hydraulic cylinder located in the side box and pivotally coupled with the revolving arm.

The fabric rolling apparatus for circular knitting machines of the invention especially provides two revolving arms hinged on the side boxes. Each revolving arm has a revolving end hinged on the bottom side of the side box and a holding end coupled on the fabric rolling rod higher than the revolving end. When the fabric rolled on the fabric rolling rod gradually increases the fabric rolling rod also revolves in a revolving fabric collection stroke to adjust the fabric press component to the transmission rod set. Hence the fabric rolling apparatus can maintain the fabric quality at the initial rolling stage and the later rolling stage, including yarn density and fabric thickness, therefore can greatly reduce fabric waste caused by not meeting quality requirement and improve fabric utilization of the entire roll.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
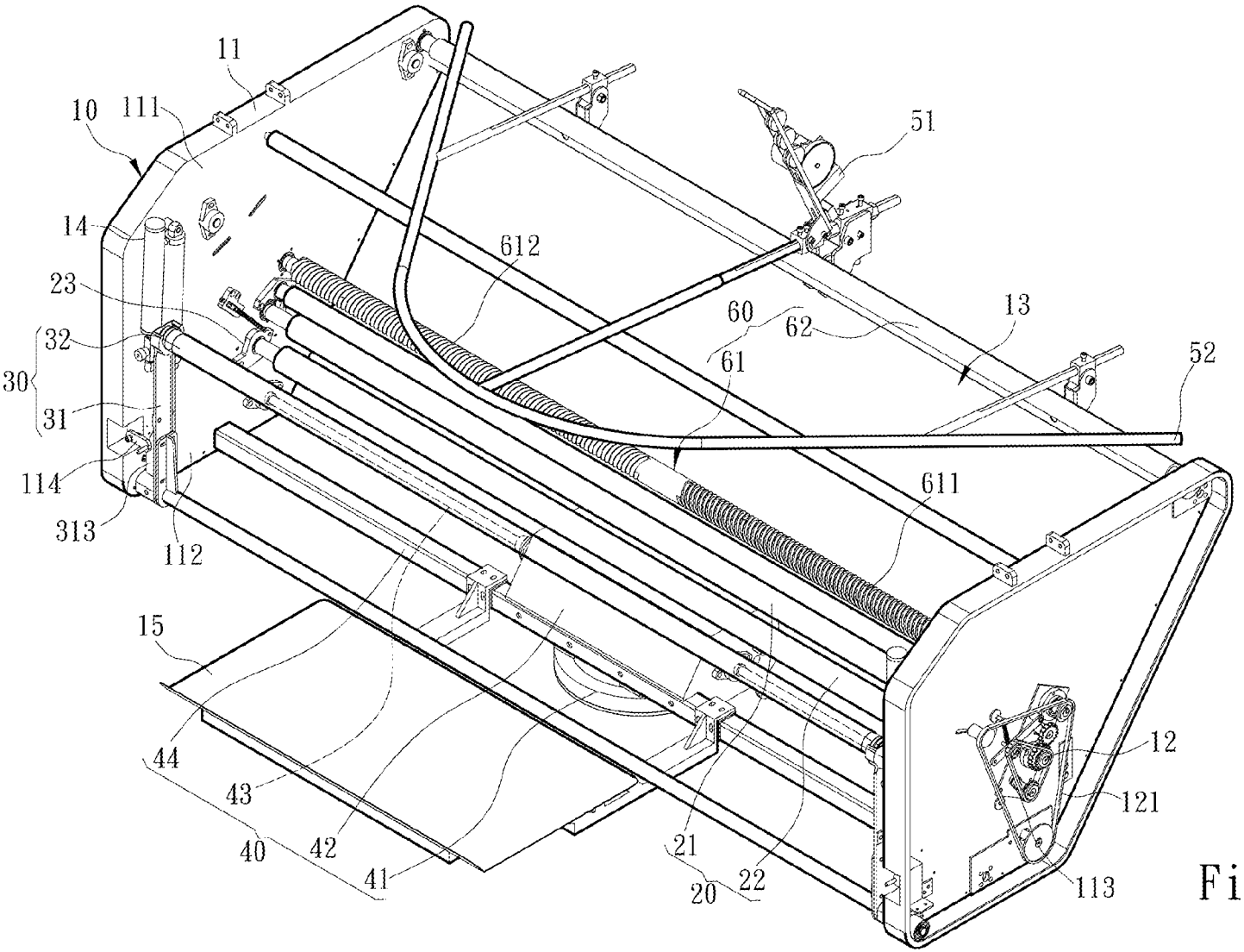
FIG. 1 is a perspective view of an embodiment of the fabric rolling apparatus for circular knitting machines of the invention.
Figure 2:
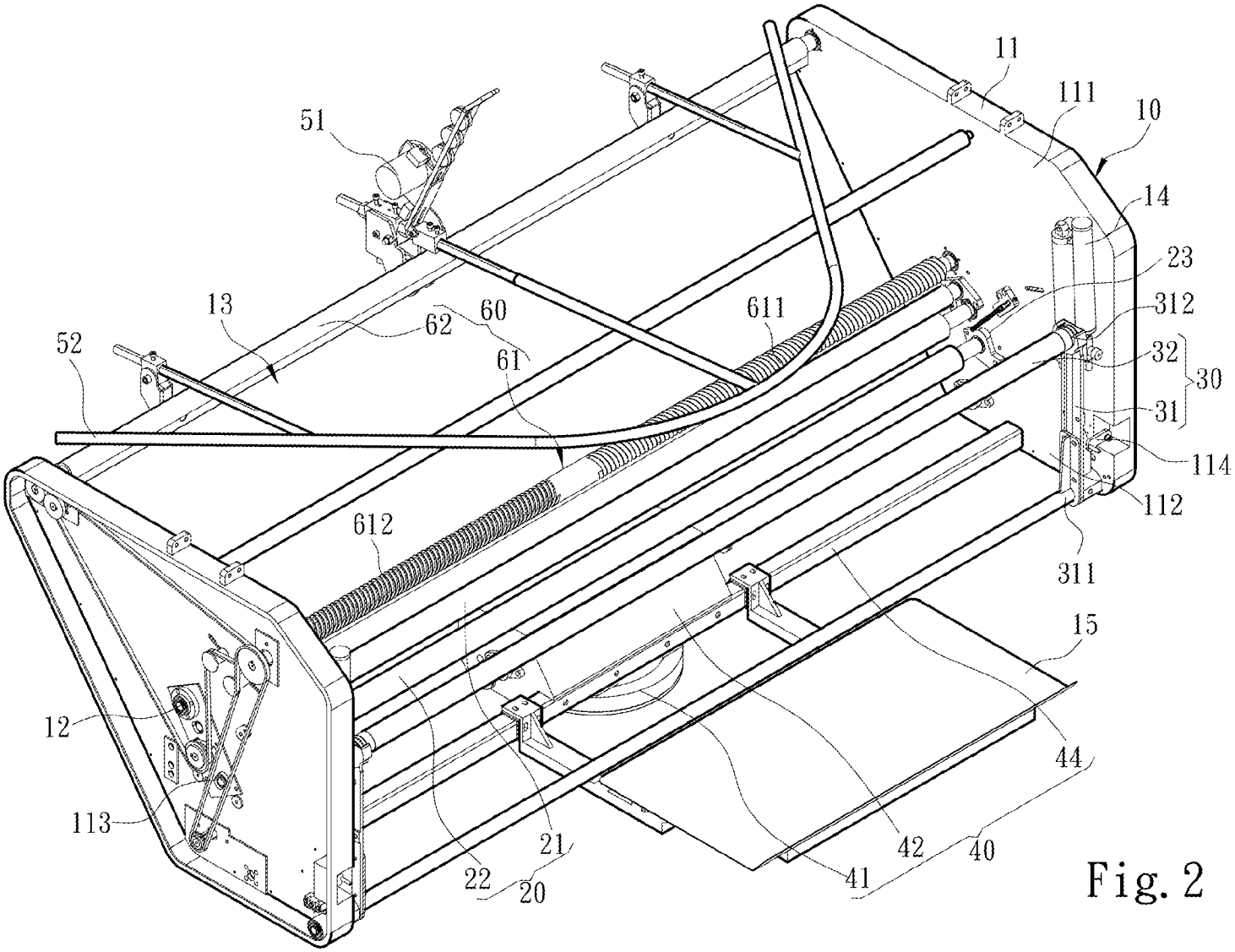
FIG. 2 is another perspective view of an embodiment of the fabric rolling apparatus for circular knitting machines of the invention.
Figure 3A:
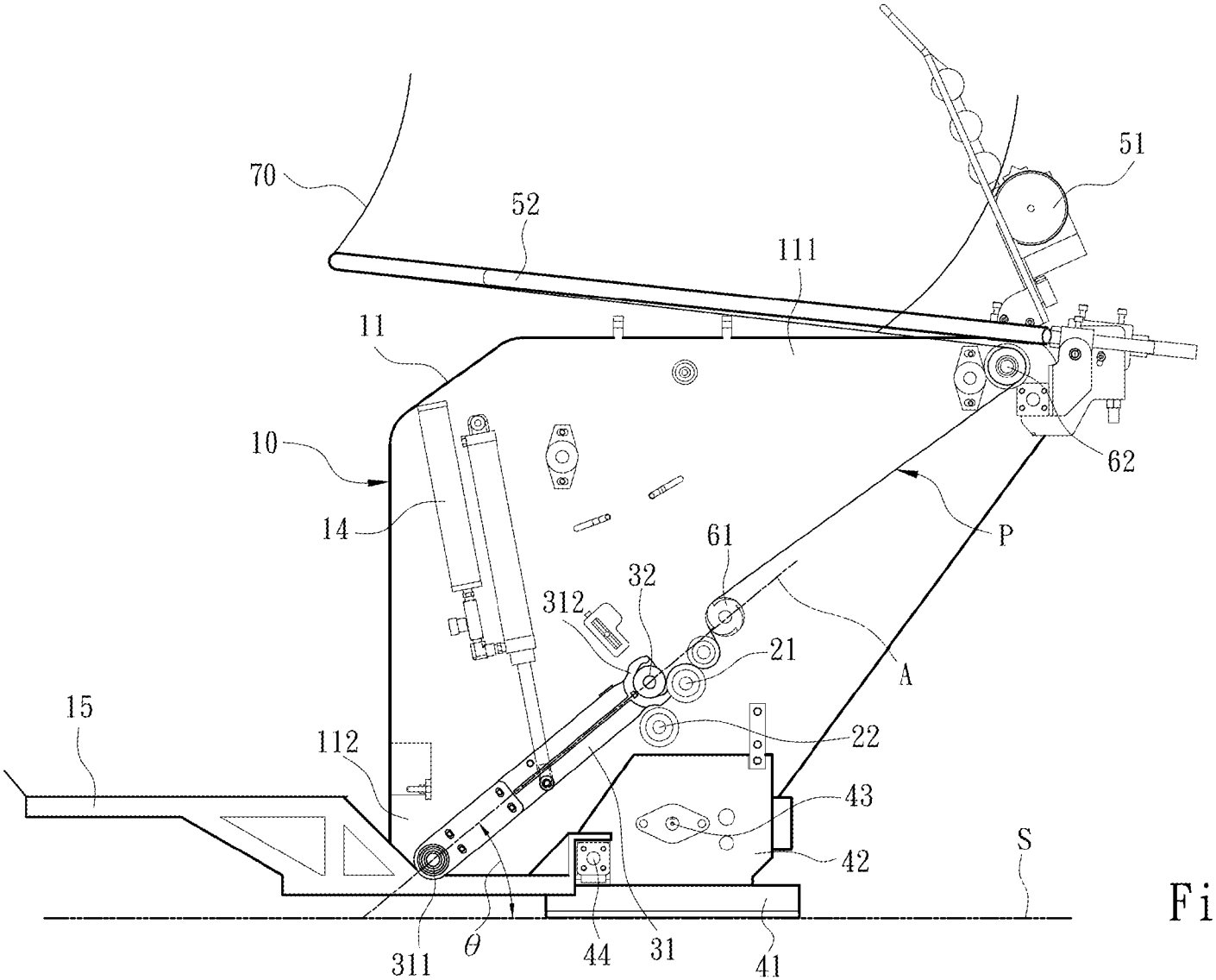
FIGS. 3A and 3B are schematic views of an embodiment of the invention showing fabric collection steps.

Please referring to FIGS. 1, 2 and 3A, the present invention aims to provide a fabric rolling apparatus that is located beneath a circular knitting machine (not shown in the drawings). It is driven by the circular knitting machine to revolve and receive a fabric 70 knitted by the circular knitting machine. The fabric rolling apparatus comprises a bracket 10, a transmission rod set 20 located on the bracket 10 and a revolving fabric collection mechanism 30. The bracket 10 includes two side boxes 11 corresponding to each other, a drive mechanism 12 located in the side boxes 11 and a fabric rolling space 13 located between the two side boxes 11. Each side box 11 has a top side 111 close to the circular knitting machine and a bottom side 112 remote from the circular knitting machine. The transmission rod set 20 is located in the fabric rolling space 13 and driven by the drive mechanism 12 to rotate and guide the fabric 70 to move along a fabric transporting path P. To provide drive power, the fabric rolling apparatus further has a drive base 40 located in the fabric rolling space 13. In this embodiment the bottom side 112 between the two side boxes 11 forms an installation plane S for the drive base 40 to mount thereon. The drive base 40 includes a revolving base 41, a speed change box 42 located on the revolving base 41, at least one transmission shaft 43 extended from the speed change box 42 to output a revolving power and at least one connection bar 44 connected the speed change box 42 and side boxes 11 so that the speed change box 42 can drive the side boxes 11 to revolve synchronously. The transmission shaft 43 runs through the bottom side 112 of the side boxes 11 and drives the drive mechanism 12 operating through a transmission belt 121. The speed change box 42 generates a torsional force output to the side boxes 11 through the transmission shaft 43. The transmission shaft 43 is connected to the transmission belt 121 to drive the drive mechanism 12 for operation.

The fabric 70 knitted by the circular knitting machine is formed in a fashion of a continuous barrel. In this embodiment the fabric rolling apparatus further includes a fabric split element 51 to split the continuous barrel to a spreading condition, and a fabric extending bracket 52 to stretch the split fabric 70. In order to enable the fabric 70 gone through the fabric split element 51 and fabric extending bracket 52 to be sent neatly in an spread manner to the fabric transporting path P, the fabric rolling apparatus further has a fabric transporting assembly 60 pivotally located on the top side 111 of the side boxes 11 that includes a fabric spread rod 61 driven by the drive mechanism 12 to revolve and spread the fabric 70 and at least one rolling rod 62 to guide the fabric 70 to move toward the fabric spread rod 61. The fabric spread rod 61 includes a first thread section 611 and a second thread section 612 in an opposite direction against the first thread section 611 to push the split and creased fabric 70 to two opposite directions to maintain the surface of the fabric 70 in a smooth and flat condition. The fabric 70 passed through the rolling rod 62 and fabric spreading rod 61 enters the transmission rod set 20 which also is driven by the drive mechanism 12 in the side boxes 11. The fabric 70 is moved along the fabric transporting path P and sent to the revolving fabric collection mechanism 30. In the invention the revolving fabric collection mechanism 30 includes two revolving arms 31 hinged respectively on the side boxes 11 and a fabric rolling rod 32 located on the fabric transporting path P and driven by the transmission rod set 20 to revolve to roll and collect the fabric 70. Each revolving arm 31 has a revolving end 311 hinged on the bottom side 112 of the side box 11 and a holding end 312 coupled on the fabric rolling rod 32 higher than the revolving end 311. The revolving arm 31 has a revolving fabric collection stroke to flip upward from the bottom side 112 about the revolving end 311 as an axis with increased fabric 70 amount on the fabric rolling rod 32. The fabric 70 rolled on the fabric rolling rod 32 presses the transmission rod set 20 to provide a fabric press component to the transmission rod set 20. To allow the revolving arm 31 to drive the fabric rolling rod 32 to move smoothly during the revolving fabric collection stroke the bracket 10 also includes at least one buffer hydraulic cylinder 14 hinged on the revolving arm 31.

Figure 5:
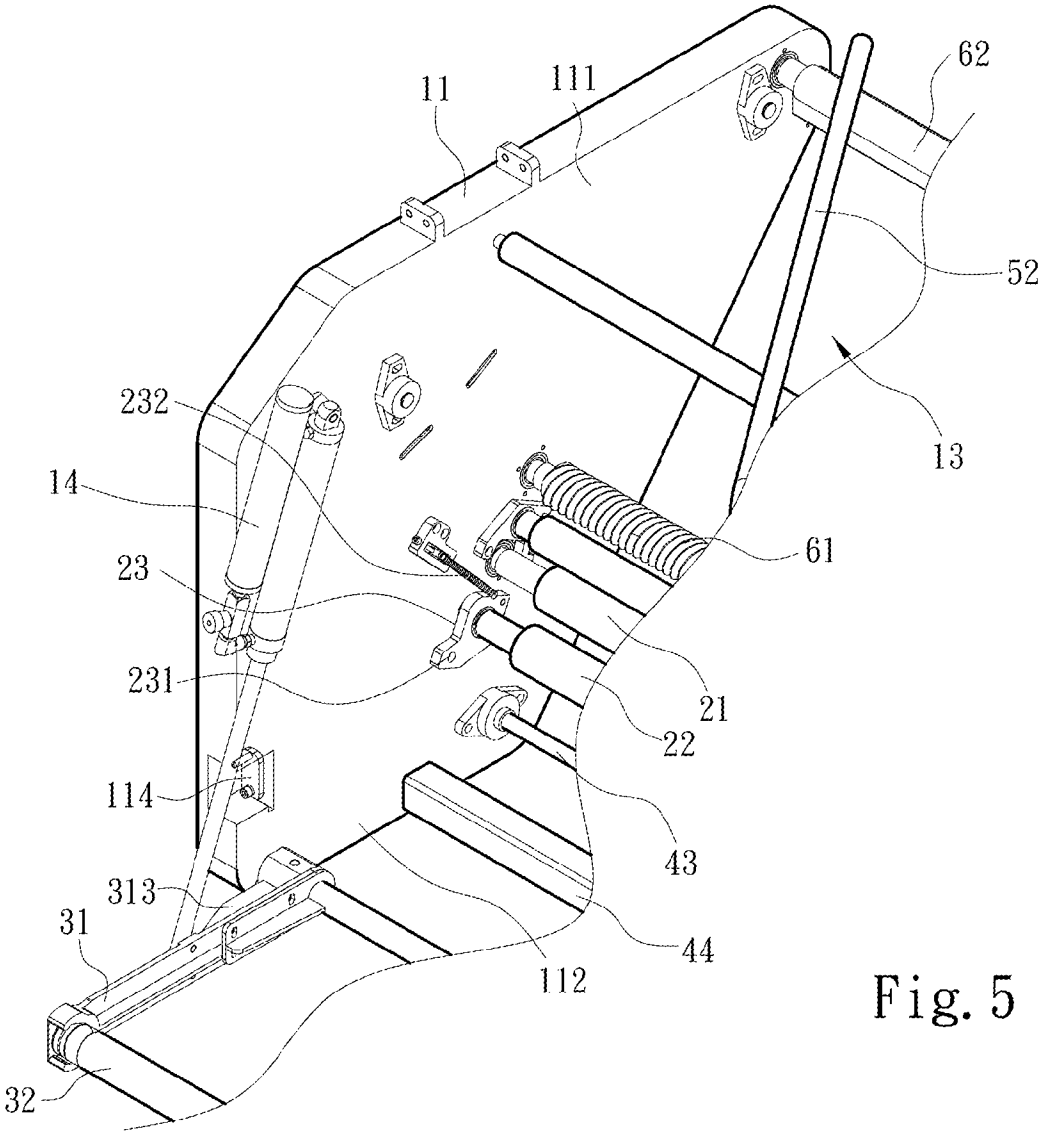
FIG. 5 is a schematic view of an embodiment of the invention showing the limit portion in the side box in an open condition.

When the amount of the fabric 70 wound on the fabric rolling rod 32 increases the circumferential length at the outmost perimeter thereof also increases. In order to make the transmission rod set 20 to closely press the fabric 70 and revolve the fabric 70 wound on the fabric rolling rod 32 through friction forces, the transmission rod set 20 also has a first fabric guiding rod 21 pivotally coupled on the side boxes 11, a second fabric guiding rod 22 run through the side boxes 11 and moving relatively to the first fabric guiding rod 21 and a movement dock 23 coupled on the second fabric guiding rod 22 to control movement thereof. Each side box 11 has a track 113 run through by the second fabric guiding rod 22 for moving therein. Referring to FIG. 5, the movement dock 23 includes a pivotal coupling portion 231 hinged on the side box 11 and an elastic element 232 connected to the movement dock 23 to provide a return force. Thus, the distance between the second fabric guiding rod 22 and first fabric guiding rod 21 can be adjusted according to the outmost circular curvature of the fabric 70 on the fabric rolling rod 32, thereby the first and second fabric guiding rods 21 and 22 can be constantly maintained in contact with the fabric 70 on the fabric rolling rod 32 at the outmost circumference to drive the fabric 70 to revolve.

Figure 3B:
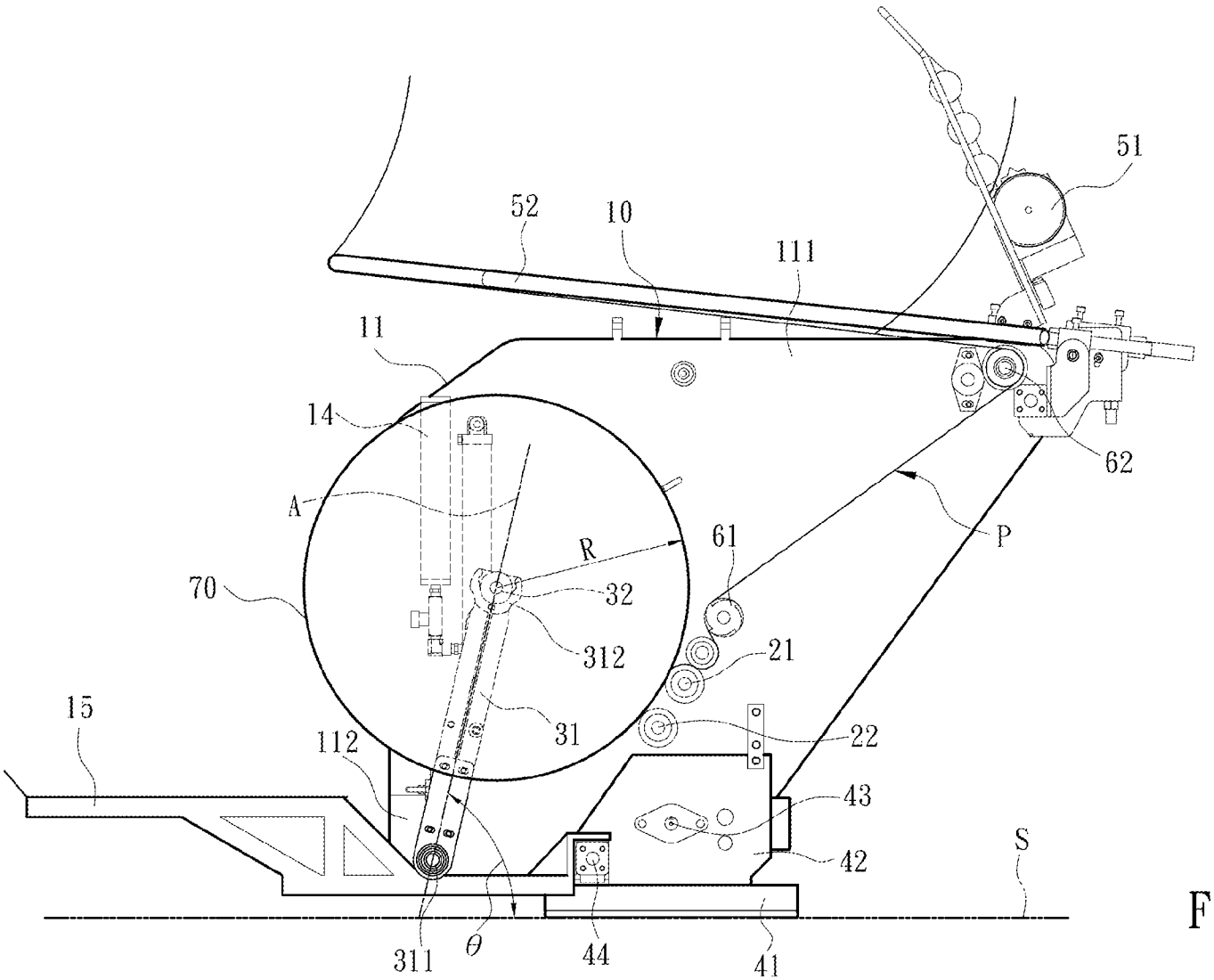

Please refer to FIGS. 3A and 3B for the fabric rolling apparatus of the invention in operation for fabric collection conditions. As shown in FIG. 3A, the fabric rolling rod 32 rolls the fabric 70 output from the transmission rod set 20. As previously discussed, the installation plane S is formed between the bottom side 112 of the two side boxes 11 to hold the drive base 40, and the installation plane S and an extended axis A of the revolving arm 31 in the revolving fabric collection stroke form an included angle θ. With increasing of the amount of the fabric 70 wound on the fabric rolling rod 32, as shown in FIG. 3B, the radius of the fabric 70 wound on the fabric rolling rod 32 that has the fabric rolling rod 32 as the circular center also increases; since the circumference of the fabric 70 presses the transmission rod set 20, the fabric rolling rod 32 is driven and raised, consequentially, the revolving arm 31 is flipped upwards about the revolving end 311 as an axis from the bottom side 112 in the revolving fabric collection stroke; meanwhile, the angle θ between the installation plane S and the extended axis A of the revolving arm 31 in the revolving fabric collection stroke also increases.

Through the revolving arm 31 in the revolving fabric collection stroke the fabric press component Y which the fabric 70 on the fabric rolling rod 32 exerts to the transmission rod set 20 can be adjusted. Please refer to FIGS. 6 and 7 for the force distribution in the fabric collection conditions. The fabric 70 and fabric rolling rod 32 have a gravity W which provides a fabric press component Y to the transmission rod set 20 and a support component X to the revolving arm 31. At different fabric rolling diameters R, the relationship among the gravity W, included angle θ and fabric press component Y is shown in a table below:

| | Fabric Diameter R (mm) | Gravity W (kg) | Angle θ (θ°) | cosθ | Fabric press Component Y (kg) |
|---|---|---|---|---|---|
| 1 | 50 | 1 | 38.00 | 0.788 | 0.788 |
| 2 | 273 | 37 | 52.96 | 0.602 | 22.288 |
| 3 | 386 | 75 | 60.67 | 0.490 | 36.738 |
| 4 | 473 | 112 | 66.70 | 0.396 | 44.301 |
| 5 | 547 | 150 | 71.91 | 0.311 | 46.577 |
| 6 | 611 | 187 | 76.49 | 0.234 | 43.686 |
| 7 | 670 | 225 | 80.79 | 0.160 | 36.012 |

Figure 7:
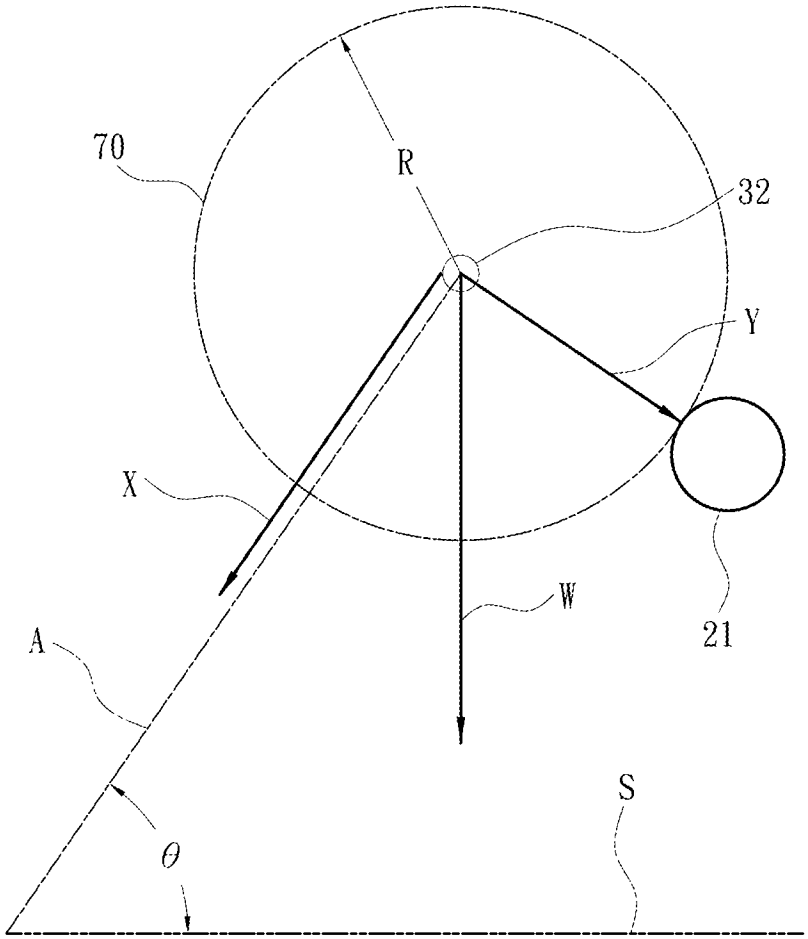
FIG. 7 is a schematic view of an embodiment of the invention showing the component force combination in a fabric collection condition.
Figure 6:
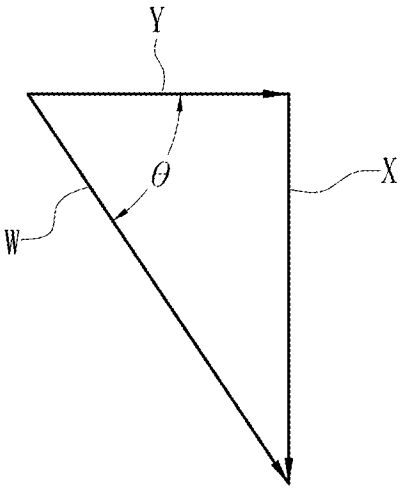
FIG. 6 is a schematic view of an embodiment of the invention showing the component force relationships in a fabric collection condition.

Based on FIGS. 6 and 7, the relationship between the fabric press component Y and gravity W is: $Y=W\cos\theta$. Since angle θ is defined at the cross between the installation plane S and the extended axis A of the revolving arm 31 in the revolving fabric collection stroke, when the angle θ increases with increased fabric rolling amount from the conditions in FIG. 3A to FIG. 3B (with the angle θ smaller than 90 degrees), the value of cos θ also decreases gradually (referring to the table above). Hence although the gravity W gradually increases during the rolling process of the fabric 70 on the fabric rolling rod 32, the value of cos θ decreases, hence the fabric press component Y applied to the transmission rod set 20 can be adjusted, thereby during the fabric rolling process of the fabric 70 through the fabric rolling apparatus the fabric press component Y applied to the transmission rod set 20 resulted from the gravity W does not increase linearly.

Figure 4:
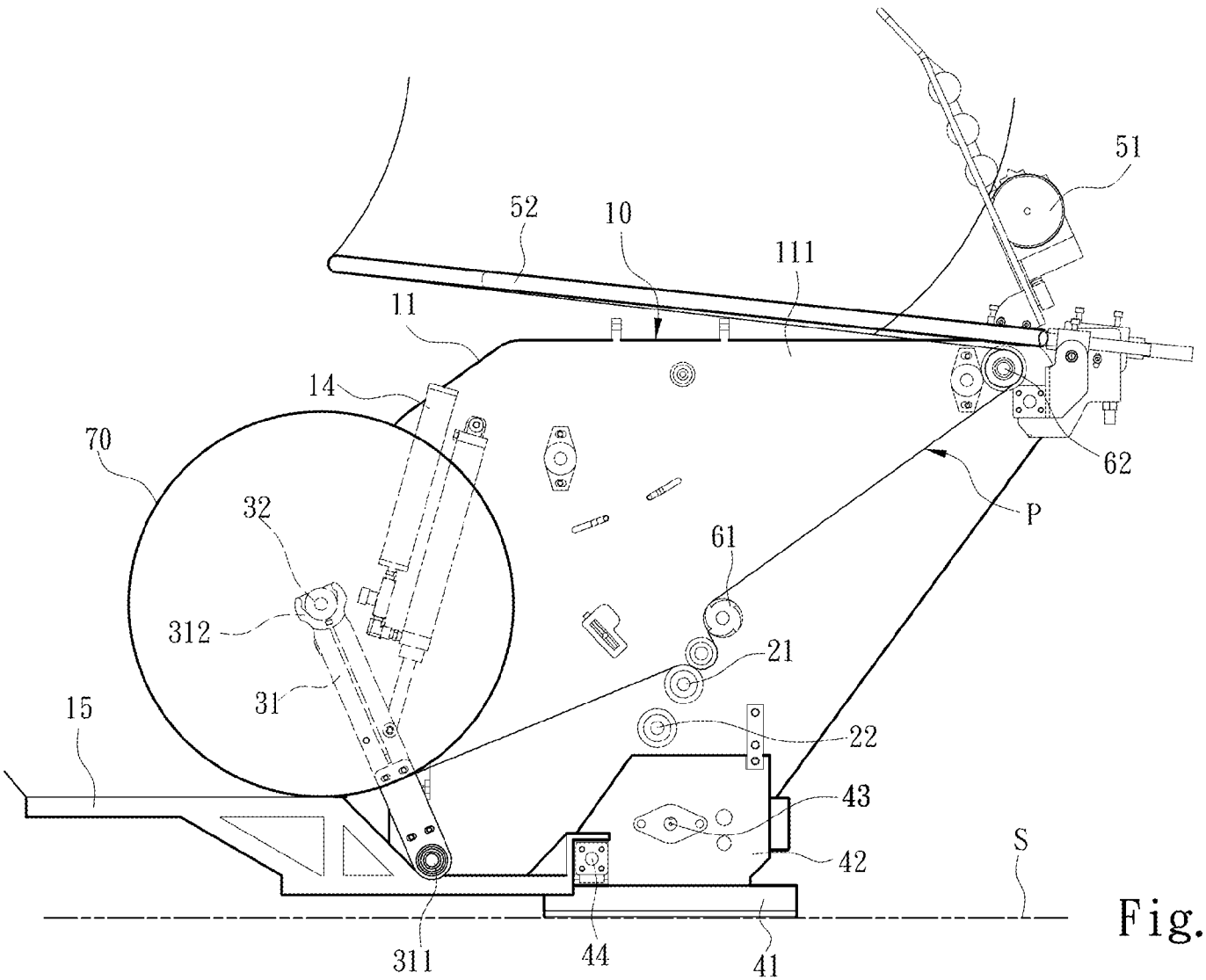
FIG. 4 is a schematic view of an embodiment of the invention showing a fabric unloading condition.

When the fabric 70 wound on the fabric rolling rod 32 has reached a preset amount, the revolving arm 31 is moved away from the revolving fabric unloading stroke in the fabric rolling space 13 about the revolving end 311 as an axis, as shown in FIG. 4. As the revolving arm 31 is hinged on the side box 11 via the buffer hydraulic cylinder 14, when the revolving arm 31 proceeds the revolving fabric unloading stroke the buffer hydraulic cylinder 14 provides a buffer force opposite to the gravity W, hence the fabric 70 wound on the fabric rolling rod 32 can be unloaded smoothly. In this invention, the bracket 10 also includes a fabric unloading bracket 15 to hold the fabric 70 in the revolving fabric unloading stroke. In addition, to avoid the fabric 70 from winding too much on the fabric rolling rod 32 that might cause the revolving arm 31 directly entering from the revolving fabric collection stroke to the revolving fabric unloading stroke the revolving arm 31 further has a stopper 313, and the side box 11 has a limit portion 114 to butt the stopper 313 to prohibit the revolving arm 31 to proceed the revolving fabric unloading stroke. The limit portion 114 is hinged on the side box 11 and has a close state (referring to FIG. 1) to butt the stopper 313 and an open state to allow the stopper 313 to leave the fabric rolling space 13 (referring to FIG. 5).

As a conclusion, the fabric rolling apparatus for circular knitting machines of the invention has two special revolving arms hinged on the side boxes. Each revolving arm has a revolving end hinged on the bottom side of the side box and a holding end coupled on the fabric rolling rod higher than the revolving end. When the fabric wound on the fabric rolling rod gradually increases, the fabric rolling rod also revolves in a revolving fabric collection stroke to adjust the fabric press component to the transmission rod set, hence can overcome the problem occurred to the conventional fabric rolling machine of continuous increase of the fabric press component exerted to the transmission rod set from the total gravity of the fabric rolling rod and fabric. As a result, the fabric quality at the initial rolling stage and the later rolling stage can be maintained as desired, including yarn density and fabric thickness, thus greatly reduce the waste of the entire roll of fabric that has to be discarded due to quality not meeting requirements, and total utilization of the entire roll of fabric also increases.

What is claimed is:

1. A fabric rolling apparatus located beneath a circular knitting machine and driven to revolve by the circular knitting machine to receive a fabric knitted by the circular knitting machine, comprising:

a bracket including two corresponding side boxes, a drive mechanism located in the side boxes and a fabric rolling space located between the two side boxes, each side box including a top side close to the circular knitting machine and a bottom side remote from the circular knitting machine;

a transmission rod set located in the fabric rolling space and driven by the drive mechanism to revolve and guide the fabric to move along a fabric transporting path; and a revolving fabric collection mechanism including two revolving arms hinged respectively on the side boxes and a fabric rolling rod located in the fabric transporting path and driven by the transmission rod set to revolve and roll the fabric, each revolving arm including a revolving end hinged on the bottom side of the side box and a holding end coupled on the fabric rolling rod higher than the revolving end, the fabric wound on the fabric rolling rod pressing the transmission rod set to provide a fabric pressure component to the transmission rod set, each revolving arm being driven by increase of fabric amount on the fabric rolling rod to form a revolving fabric collection stroke in which the holding end rotates about the revolving end thereof to move upward from the bottom side of the side box to adjust the fabric pressure component.

2. The fabric rolling apparatus for circular knitting machines of claim 1 further including a drive base located in the fabric rolling space, the drive base including a revolving base, a speed change box located on the revolving base and at least one transmission shaft extended from the speed change box to output a revolving drive force, and the drive base being mounted onto an installation plane formed between the bottom side of the two side boxes, the installation plane and an extended axis of the revolving arm in the revolving fabric collection stroke forming an included angle smaller than 90°.

3. The fabric rolling apparatus for circular knitting machines of claim 1, wherein the transmission rod set includes a first fabric guiding rod pivotally located on the side boxes and a second fabric guiding rod moving relatively to the first fabric guiding rod.

4. The fabric rolling apparatus for circular knitting machines of claim 3, wherein each side box includes a track run through by the second fabric guiding rod for moving therein.

5. The fabric rolling apparatus for circular knitting machines of claim 3, wherein the transmission rod set includes a movement dock coupled on the second fabric guiding rod, the movement dock including a pivotal coupling portion hinged on the side boxes and an elastic element connected to the movement dock to provide a return force.

6. The fabric rolling apparatus for circular knitting machines of claim 1, wherein each revolving arm includes a revolving fabric unloading stroke about the revolving end as an axis and remote from the fabric rolling space.

7. The fabric rolling apparatus for circular knitting machines of claim 6, wherein the bracket includes a fabric unloading bracket located in the revolving fabric unloading stroke.

8. The fabric rolling apparatus for circular knitting machines of claim 6, wherein each revolving arm includes a stopper, the side box including a limit portion butting the stopper to prohibit the revolving arm to proceed the revolving fabric unloading stroke.

9. The fabric rolling apparatus for circular knitting machines of claim 1, wherein the bracket includes at least one buffer hydraulic cylinder located on the side box and hinged on the revolving arm.

* * * * *